US006955126B2

(12) United States Patent
Taylor

(10) Patent No.: US 6,955,126 B2
(45) Date of Patent: Oct. 18, 2005

(54) RAILROAD HOPPER CAR LONGITUDINAL DOOR ACTUATING MECHANISM

(76) Inventor: Fred J. Taylor, 6485 Rogers La., Burlington, KY (US) 41005

( * ) Notice: Subject to any disclaimer, the term of this patent is extended or adjusted under 35 U.S.C. 154(b) by 0 days.

(21) Appl. No.: 10/977,008

(22) Filed: Oct. 29, 2004

(65) Prior Publication Data

US 2005/0092202 A1 May 5, 2005

Related U.S. Application Data

(60) Provisional application No. 60/515,881, filed on Oct. 30, 2003.

(51) Int. Cl.[7] ..... B61D 3/00

(52) U.S. Cl. ..... 105/250; 105/286; 105/288; 105/290

(58) Field of Search ..... 105/250, 251, 105/280, 284, 286, 288, 289, 290, 296, 299

(56) References Cited

U.S. PATENT DOCUMENTS

| | | | | |
|---|---|---|---|---|
| 775,402 A | * | 11/1904 | Hitchcook | 105/290 |
| 3,187,684 A | | 6/1965 | Ortner | |
| 3,596,609 A | | 8/1971 | Ortner et al. | |
| 3,611,947 A | | 10/1971 | Nagy | |
| 3,786,764 A | | 1/1974 | Beers, Jr. et al. | |
| 3,815,514 A | | 6/1974 | Heap | |
| 3,818,842 A | | 6/1974 | Heap | |
| 3,949,681 A | | 4/1976 | Miller | |
| 4,222,334 A | | 9/1980 | Peterson | |
| 4,224,877 A | | 9/1980 | Stark et al. | |
| 4,366,757 A | | 1/1983 | Funk | |
| 4,601,244 A | | 7/1986 | Fischer | |
| 4,628,825 A | | 12/1986 | Taylor et al. | |
| 4,741,274 A | | 5/1988 | Ferris et al. | |
| 5,249,531 A | | 10/1993 | Taylor | |
| 5,823,118 A | | 10/1998 | Manstrom | |
| 6,019,049 A | | 2/2000 | Gaydos et al. | |
| 6,279,487 B1 | * | 8/2001 | Gaydos et al. | 105/289 |
| 6,405,658 B1 | | 6/2002 | Taylor | |
| 2005/0056185 A1 | * | 3/2005 | Herzog et al. | 105/286 |

* cited by examiner

*Primary Examiner*—Mark T. Le
(74) *Attorney, Agent, or Firm*—Jerrold J. Litzinger

(57) ABSTRACT

An actuating system for operating longitudinal doors of a railroad hopper car. The mechanism includes an operating member which is coupled to each end of the door set of the car by a shaft and a linkage which couples a power source to the operating member, where the operating members rotate to move the doors away from the hopper. Reversing the rotation of the operating members closes the door set of the hopper. The mechanism can be used in new car construction, and can also be retrofitted onto existing hopper cars.

19 Claims, 17 Drawing Sheets

RAILROAD HOPPER CAR LONGITUDINAL DOOR ACTUATING MECHANISM

CROSS REFERENCE TO RELATED APPLICATIONS

This application claims benefit from U.S. Provisional Application Ser. No. 60/515,881, filed Oct. 30, 2003, which application is incorporated herein by reference.

BACKGROUND OF THE INVENTION

1. Field of the Invention

The present invention relates generally to an apparatus for opening the rotating doors of a railroad hopper car, and, in particular, to a novel apparatus capable of opening longitudinal doors on a railroad car.

2. Description of the Prior Art

A common type of railroad freight car in use today is the freight car of the type wherein the load is discharged through hoppers in the underside of the body. Such cars are generally referred to as hopper cars and are used to haul coal, phosphate and other commodities.

After hopper cars are spotted over an unloading pit, the doors of the hoppers a re opened, allowing the material within the hopper to be emptied into the pit.

Hopper cars, which may be covered, are usually found with one of two hopper configurations: transverse, in which the doors closing the hoppers are oriented perpendicular to the center line of the car; or longitudinal, in which the doors closing the hoppers are oriented parallel to the center line of the car. An example of a hopper car with transverse doors is shown in U.S. Pat. No. 5,249,531, while an example of a hopper car with longitudinal doors is shown in U.S. Pat. No. 4,224,877.

Prior art references which teach operating mechanisms for opening and closing hopper doors include U.S. Pat. Nos. 3,596,609; 4,741,274; 3,187,684; 3,611,947; 3,786,764; 3,815,514; 3,818,842; 3,949,681; 4,222,334; 4,366,757; 4,601,244; 5,823,118; and 5,249,531. There are several disadvantages to the hopper door operating mechanisms described in some of the aforementioned patents. One problem is that some of the prior art mechanisms are designed such that each actuating mechanism is connected to doors from two separate hoppers. Thus, if the mechanism fails, it effects the operation of two hoppers. Another disadvantage of some of the above described hopper door mechanisms is that the operating mechanisms limit the distance of the door motion, thus limiting the open area of the car's bottom. This arrangement slows the unloading process and causes additional costs and potential damage to the car due to increased periods in thaw sheds. A further disadvantage of some of the prior art hopper door mechanisms are that they are designed for new railcar construction.

SUMMARY OF THE INVENTION

It is therefore an object of the present invention to provide an automatic mechanism for actuating the discharge doors of a hopper car which can quickly empty the contents.

It is a further object of the present invention to provide an actuating mechanism for a hopper car doors which can be used in new car manufacturing as well as can be retrofitted to existing cars.

It is a still further object of the present invention to provide an actuating mechanism for a hopper car with longitudinal doors that can empty the contents of the railcar primarily between the rails.

It is also an object of the present invention to provide an operating mechanism for longitudinal hopper car doors which may be adapted for use on a railcar having no center sill.

It is a still further object of the present invention to provide an actuating mechanism for hopper car doors in which each door mechanism uses a positive over-center locking feature to securely close the doors.

These and other objects of the present invention will be more readily apparent from the descriptions and drawings which follow.

BRIEF DESCRIPTION OF A PREFERRED EMBODIMENT

Figure 1:
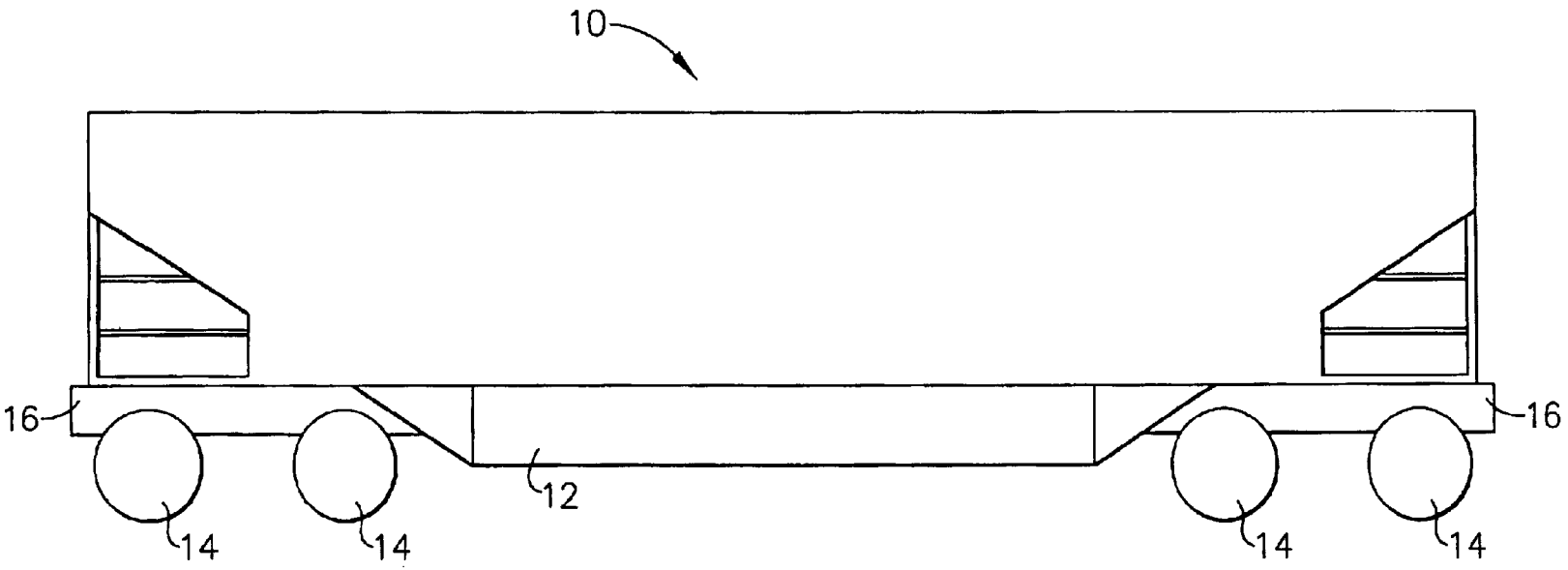
FIG. 1 (PRIOR ART)
FIG. 1 is an elevational view of a standard hopper car having longitudinal doors onto which the door actuating mechanism of the present invention may be incorporated.

Referring now to FIG. 1, there is shown a typical hopper railcar, generally indicated at 10, having longitudinal doors which may be equipped with a preferred embodiment of the present invention. Car 10 is provided with a pair of longitudinal doors 12, a plurality of wheels 14, and longitudinally extending center sill 16.

Figure 2:
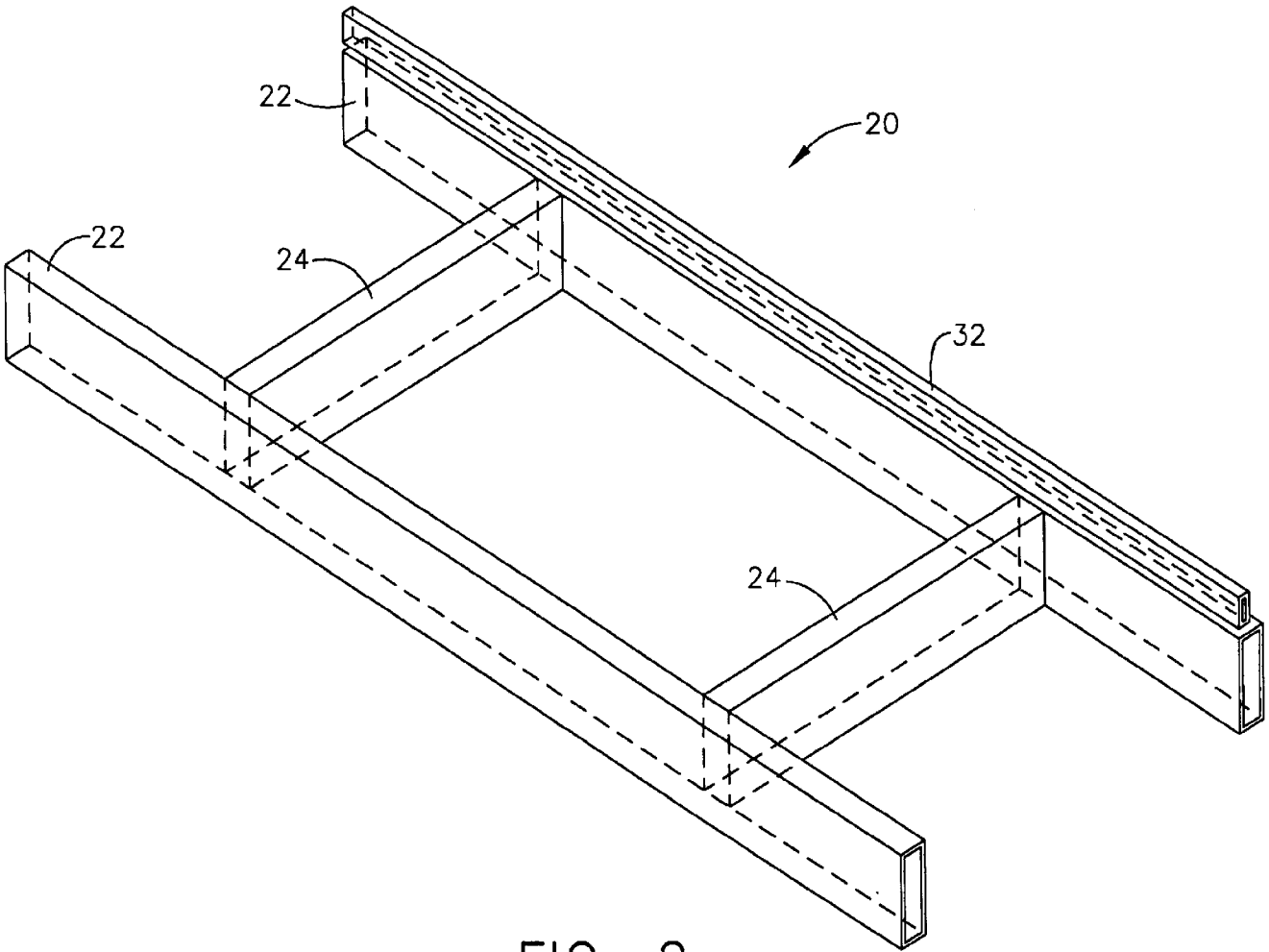
FIG. 2 shows a support frame for use with the present invention.
Figure 3:
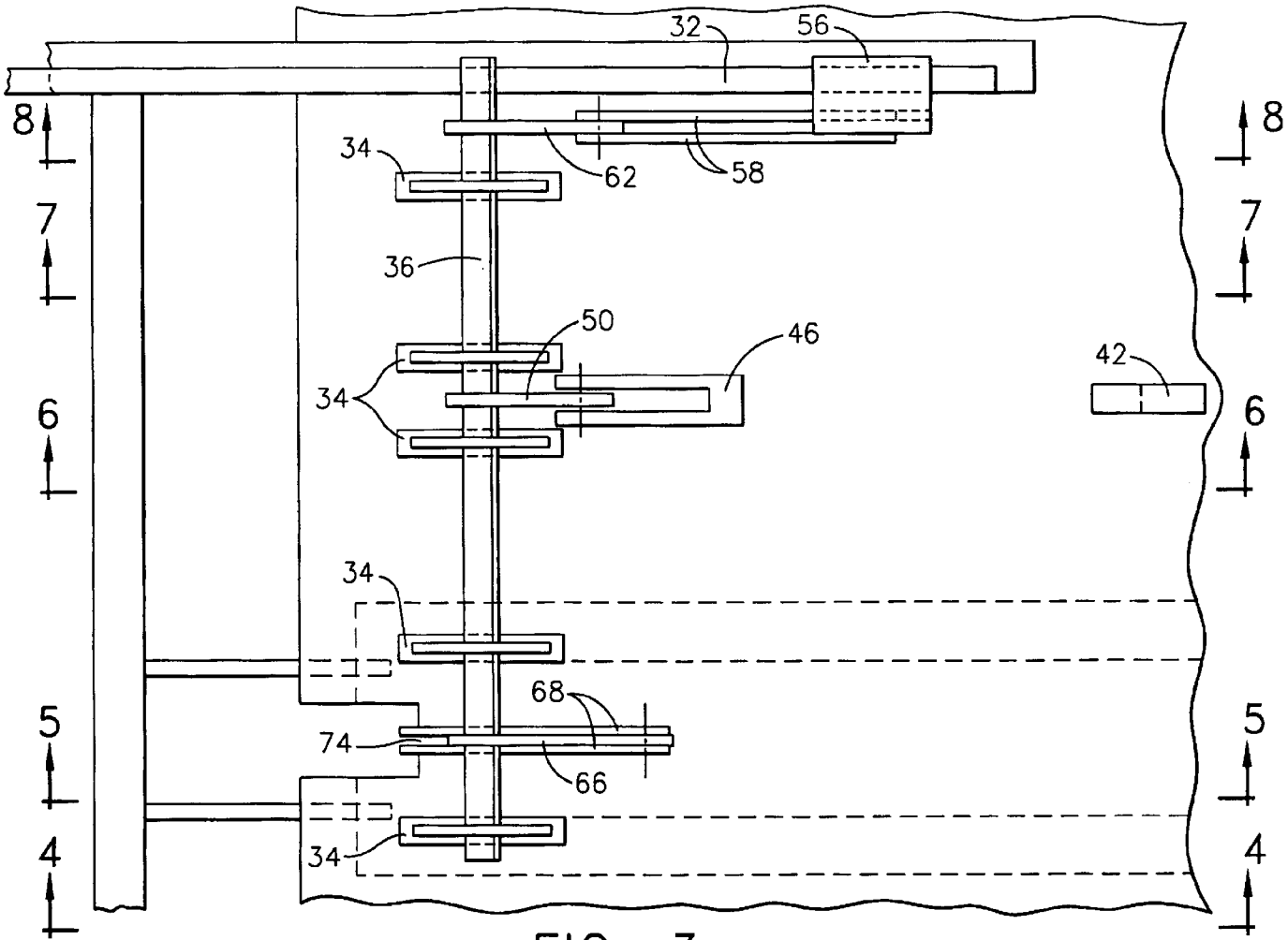
FIG. 3 is a top view of one end of the door actuating mechanism of the present invention shown in the unactuated position.
Figure 10:
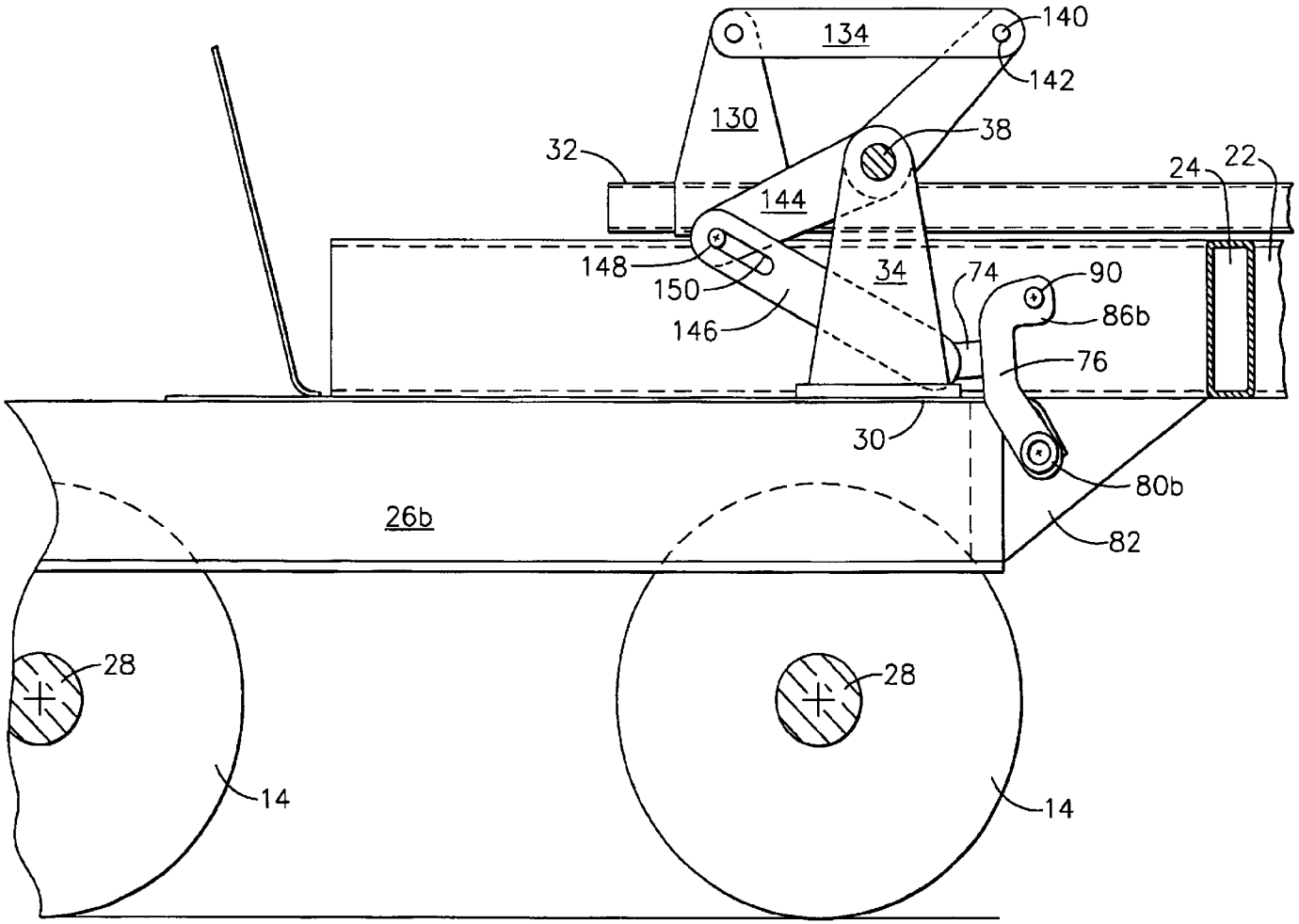
FIG. 10 is a sectional view taken along lines 10—10 of FIG. 9.
Figure 11:
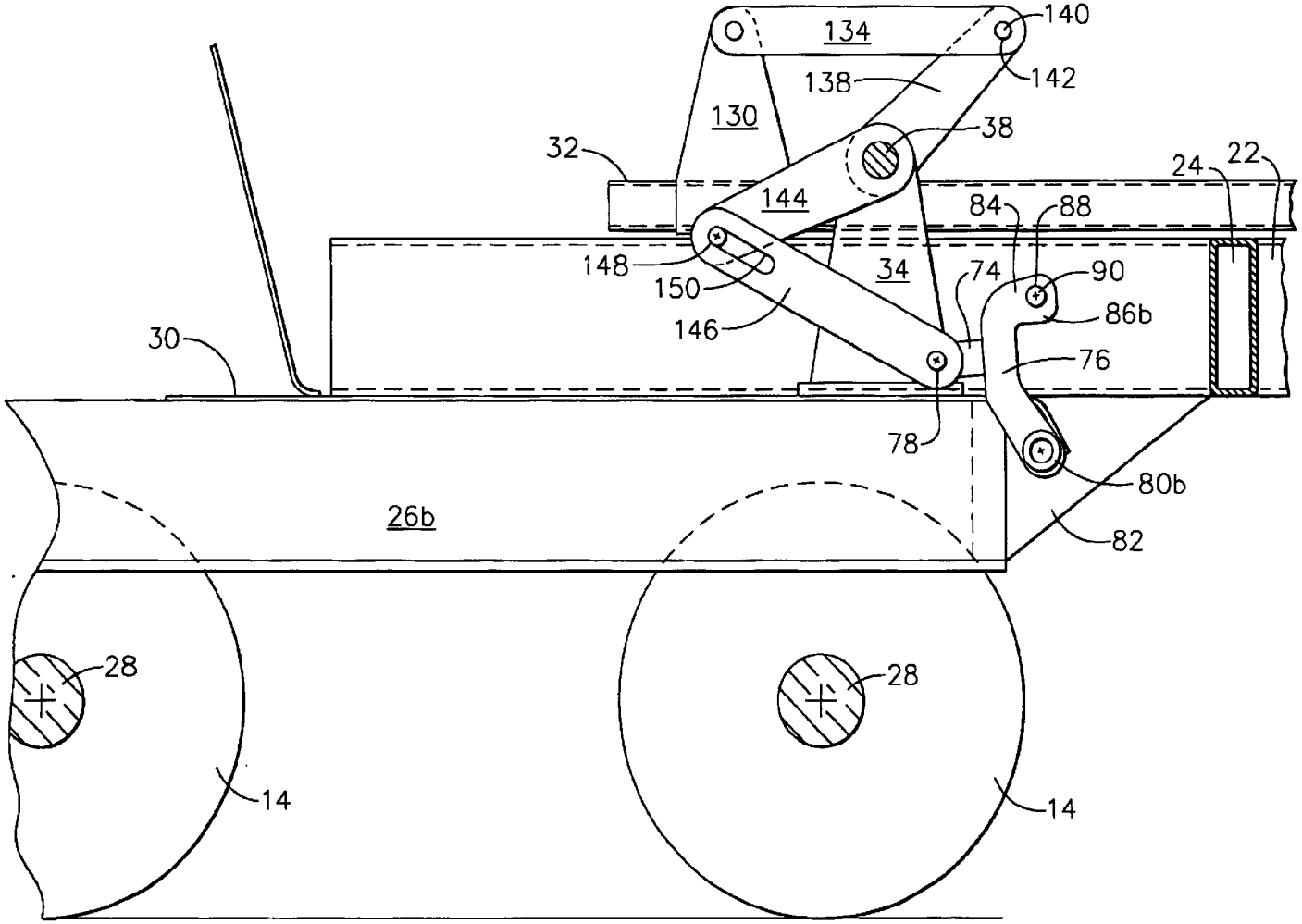
FIG. 11 is a sectional view taken along lines 11—11 of FIG. 9.
Figure 12:
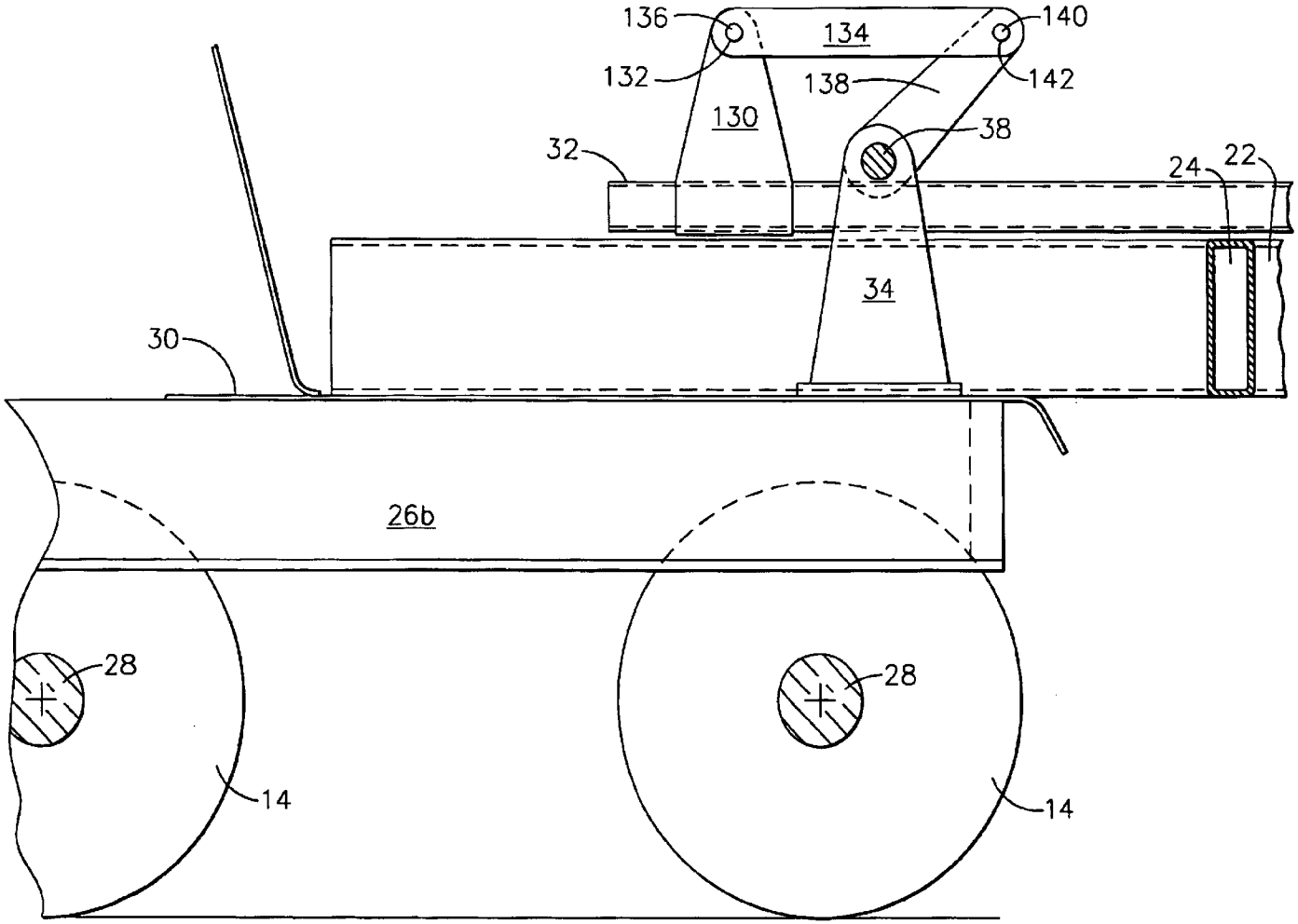
FIG. 12 is a sectional view taken along lines 12—12 of FIG. 9.
Figure 13:
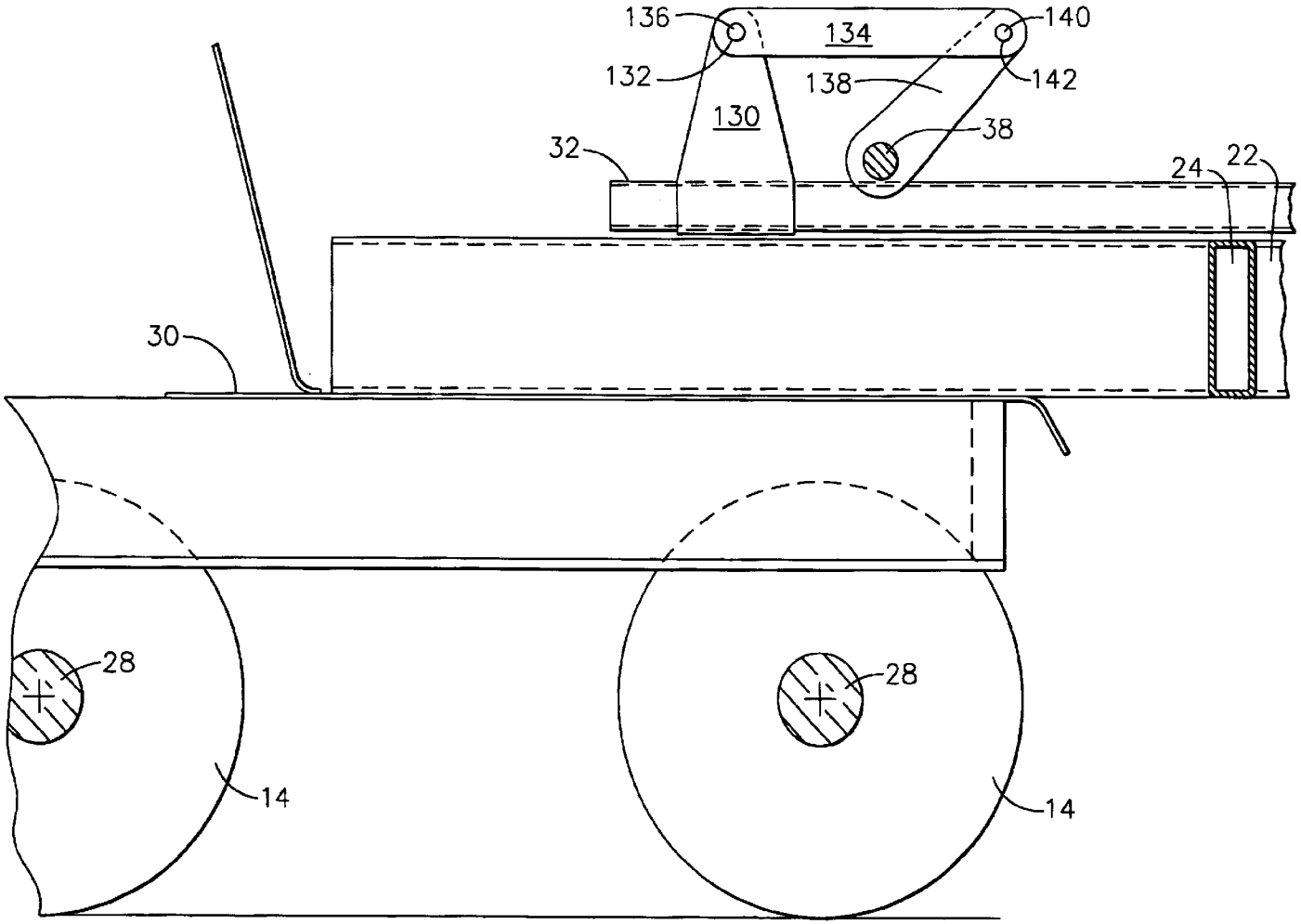
FIG. 13 is a sectional view taken along lines 13—13 of FIG. 9.

The preferred embodiment of the present invention can also be installed on a hopper car which does not have a center sill. Referring now to FIG. 2, a support frame, generally indicated at 20, consists of a pair of horizontal beams 22 coupled to a pair of transverse beams 24. Support frame 20 forms a single hopper for railcar 10 which is covered by a pair of longitudinal doors 12. Support frame 20 is mounted between a pair of stub sills 26*a,b* located at each end of car 10. (see FIGS. 4 and 10), where each sill contains sets of wheels 14, with each set mounted on an axle 28. A bolster shear plate 30 is located on top of each stub sill 26*a,b*. Located above one of horizontal beams 22 is an actuating beam 32.

A series of support pedestal bases 34 are mounted linearly across shear plate 30 and each stub sill 26*a,b*. An operating shaft 36 is rotatably coupled through bases 34 located on stub sill 26*a*, while an operating shaft 38 is rotatably coupled through bases 34 on stub sill 26*b*. An air cylinder 40 is mounted to shear plate 30 of stub sill 26*a* by a bracket 42 and a pin 44. A bifurcated clevis 46 is attached to the activating shaft 49 of air cylinder 40.

An operating lever 50 containing an elongated slot 52 is coupled at one end between the bifurcated arms of clevis 46 by a pin 54 through slot 52 such that pin 54 is captured within slot 52. The other end of lever 50 is affixed on shaft 36 between a pair of pedestal bases 34.

Figure 7:
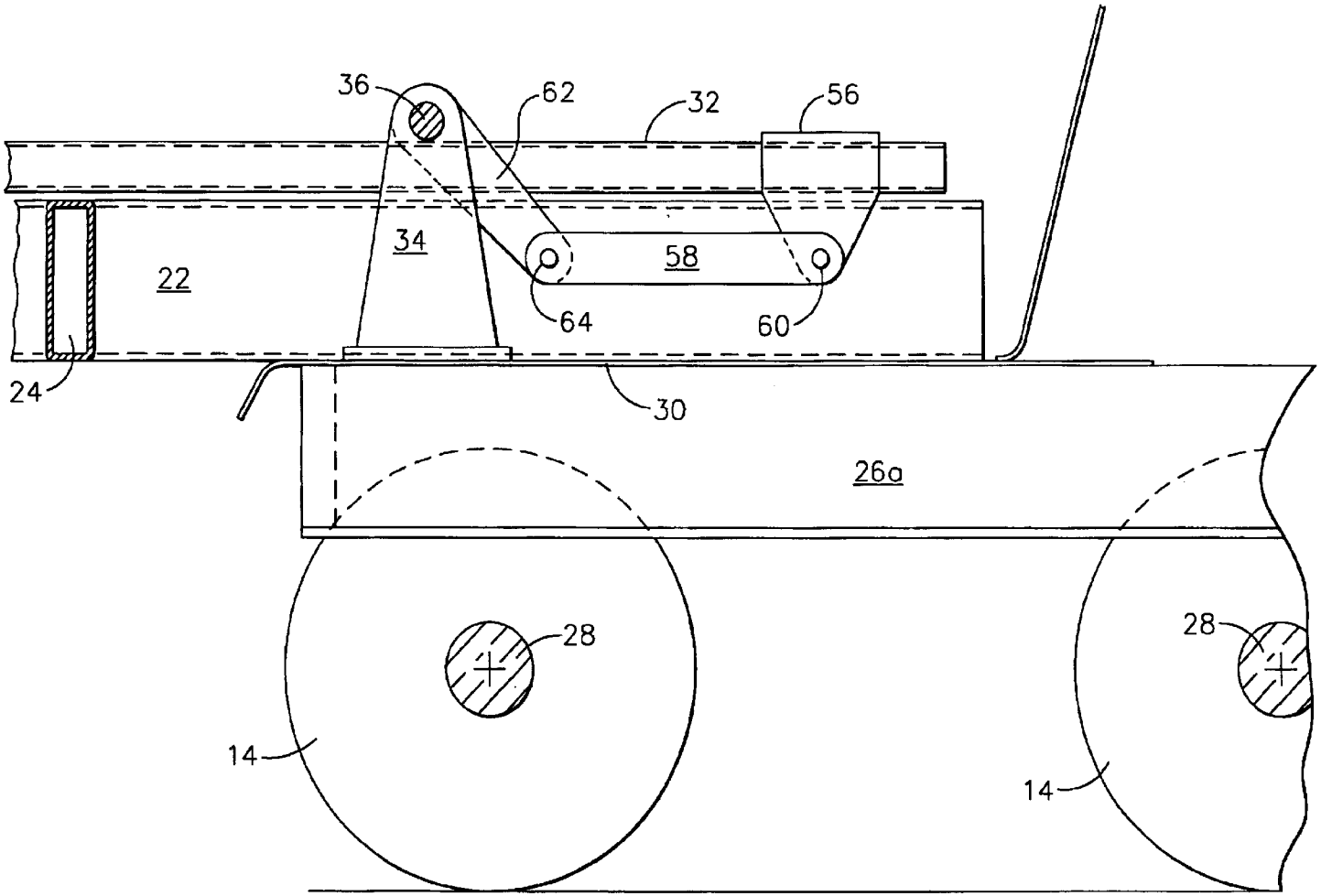
FIG. 7 is a sectional view taken along lines 7—7 of FIG. 3.

An actuating beam fulcrum 56 is rigidly affixed to actuating beam 32, as can be clearly seen in FIG. 7. Fulcrum 56 is also affixed at one end between a pair of a horizontal links 58 by a pin 60. The other end of links 58 are coupled for rotation about one end of a drive link 62 by a pin 64. The other end of drive link 62 is affixed to operating shaft 36 in the vicinity of pedestal base 34.

A lever 66 is affixed at one end on operating shaft 36, between pedestal bases 34 while at its other end lever 66 is captured between a pair of drive levers 68. Levers 68 each contain an elongated slot 70 in which a pin 72 through lever 66 is slidably received. The opposite ends of levers 68 are rotatably coupled on each side of an extension 74 of a main actuating device or member 76 by a pin 78.

Figure 15:
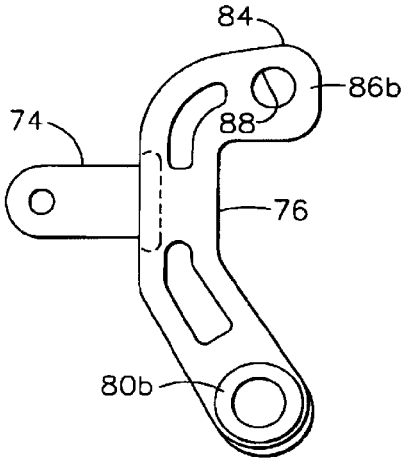
FIG. 15 is a front view of the actuating device of the present invention.
Figure 16:
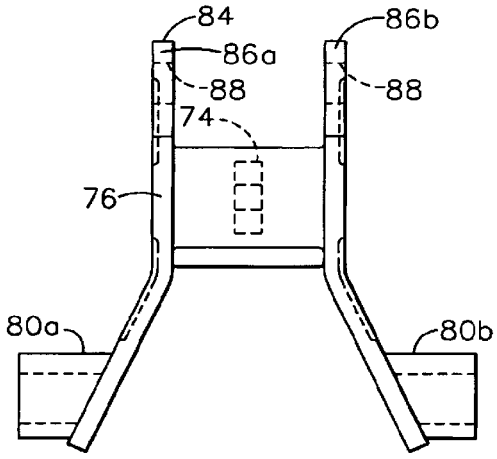
FIG. 16 is a side view of the device shown in FIG. 15.
Figure 17:
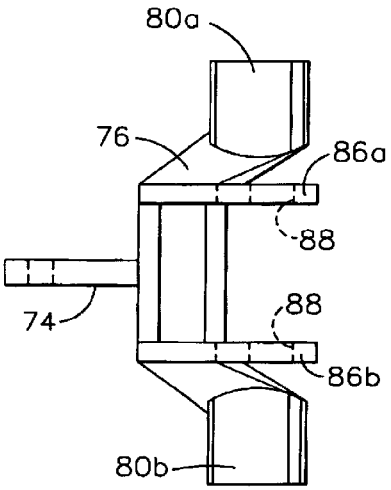
FIG. 17 is a top view of the device shown in FIG. 15.
Figure 18:
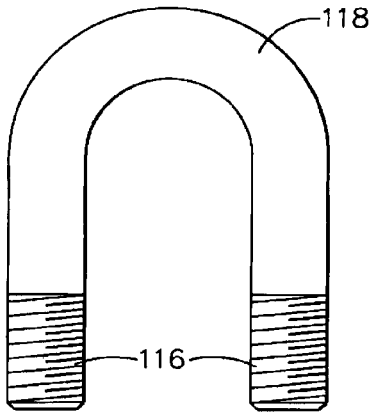
FIG. 18 is a front view of a U-bolt according to the present invention.

Main actuating device 76, which can be clearly seen in FIGS. 15–17, contains a pair of pivoting shafts 80*a,b* which are each coupled for rotation within a shaft mount reinforcer 82. Shaft reinforcers 82 are affixed to the underside of shear plate 30 and to stub sill 26*a*. For cars having a center sill 16, shaft reinforcers 82 may be affixed to the center sill. At the end of device 76 opposite shafts 80*a,b*, there is an extension 84 having bifurcated arms 86*a,b*, each of which contains a through hole 88. A pin 90 rotatably couples a transfer lever 92 between arms 86*a,b* of actuating device 76 by passing through an upper cylindrical section 94 of lever 92. Actuating device 76 is ideally positioned along the center line of car 10.

Transfer lever 92 also contains a planar section 96 having a pair of openings 98*a,b*. A pair of door supports 100 are rotatably coupled to transfer lever 92 by a pair of pins 102 which each pass through planar section 96 and between a bifurcated section 102 of door support 100 having a pair of openings 104. Supports 100 are oriented such that rotational movement of actuating device 76 causes supports 100 to shift away from one another in opposite directions. The other end of each support 100 contains a U-shaped link 106 having an open area 108.

As cylindrical section 94 of lever 92 passes through a vertical line through pivoting shafts 80*a,b* as doors 12 close, a positive overcenter lock is provided by the mechanism of the present invention, adding a safety feature to the car.

Each transverse door 12 is coupled to support 100 by a bracket 110 which is affixed to a door spreader 112 on each door 12. Bracket 110 contains a pair of holes 114 suitable for receiving the threaded ends 116 of a U-bolt 118 which is inserted through open area 108 of link 106 of door support 100. A suitable nut 120 is threaded onto each end 116 of bolt 118 to secure door 12 to support 100, as is well known in the art.

The section of the present invention located at the opposite end of the railcar can most clearly be seen in FIGS. 9–13. Note that throughout the drawings, like elements are designated with like numerals. Located on opposite stub sill 26*b* is operating shaft 38, which is rotatably coupled through pedestal bases 34 mounted on bolster shear plate 30. A reversing operating beam fulcrum 130 is rigidly affixed to beam 32 such that it travels in the same direction of beam 32. The upper end of fulcrum 130 contains an opening 132, and a pair of levers 134 are coupled on either side of fulcrum 130 by a pin 136 through opening 132. The opposite ends of levers 134 are coupled on either side of a drive lever 138 by a pin 140 which passes through apertures 142. The other end of drive lever 138 is rigidly affixed to operating shaft 38.

A lever 144 is rigidly affixed at one end to operating shaft 38 between pedestal bases 34, while the other end of lever 144 is rotatably coupled to a pair of links 146 by a pin 148 which is captured within a slot 150 in each of links 146. The opposite ends of links 146 are coupled for rotation on either side of extension 74 of main actuating device 76 by pin 78.

Figure 14:
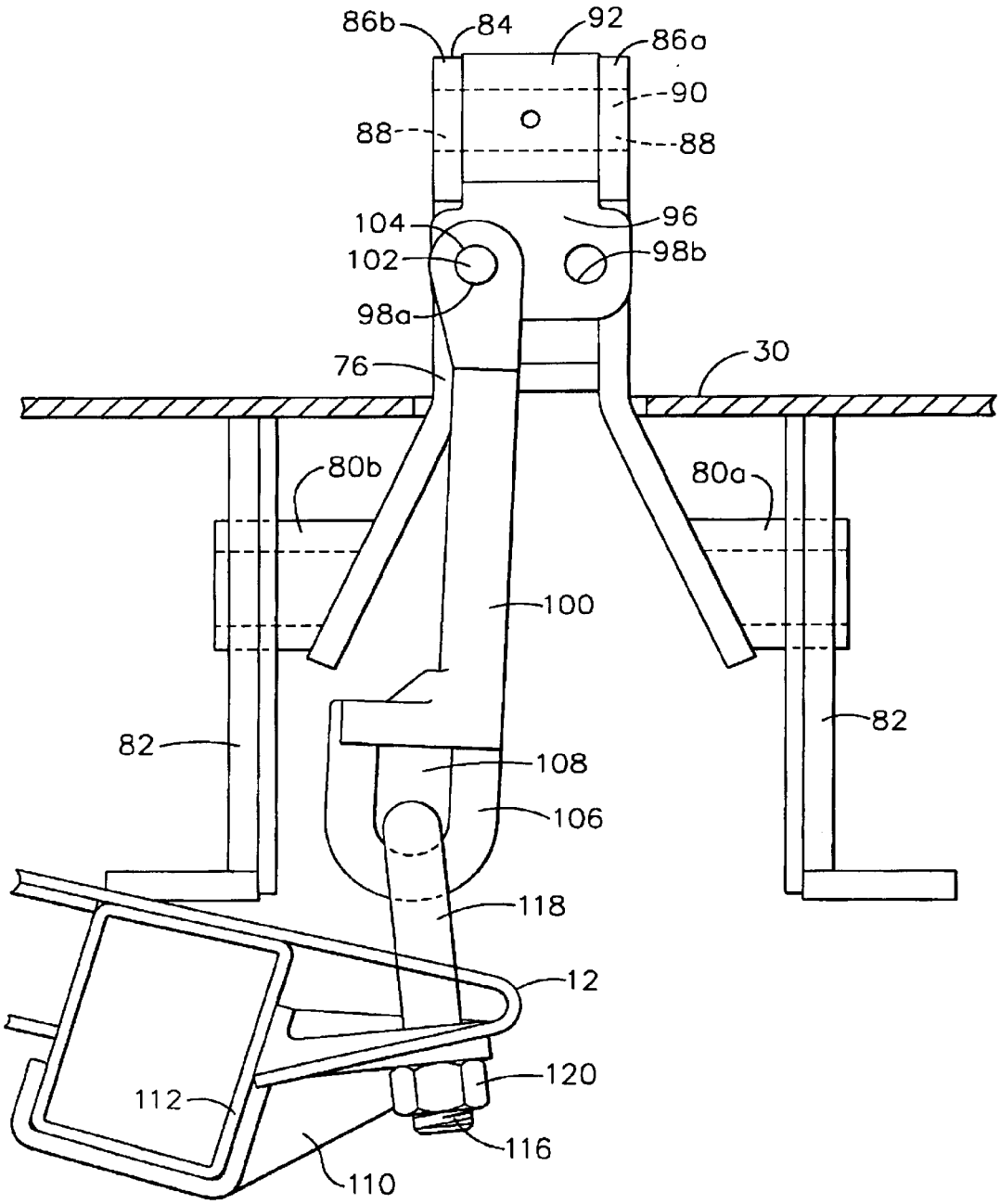
FIG. 14 is a sectional view taken along lines 14—14 of FIG. 4.

FIG. 14 clearly shows the arrangement of the present invention with one door and door support removed for clarity. Referring now to FIG. 14, an actuating device 76 is coupled for rotation by virtue of a pair of pivoting shafts 80*a,b* which are mounted within shaft mount reinforcer 82 affixed to the underside of shear plate 30 and to stub sill 26*b*. At the end of device 76 opposite shafts 80*a,b* there is an extension 84 (FIG. 16) having bifurcated arms 86*a,b*, each of which contains a through hole 88. Pin 90 rotatably couples transfer lever 92 between arms 86*a,b* of actuating device 76 by passing through upper cylindrical channel 94 of lever 92. Actuating device 76 is ideally positioned along the center line of car 10.

Figure 19:
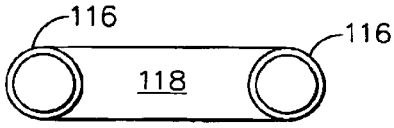
FIG. 19 is a bottom view of the U-bolt of FIG. 18.
Figure 20:
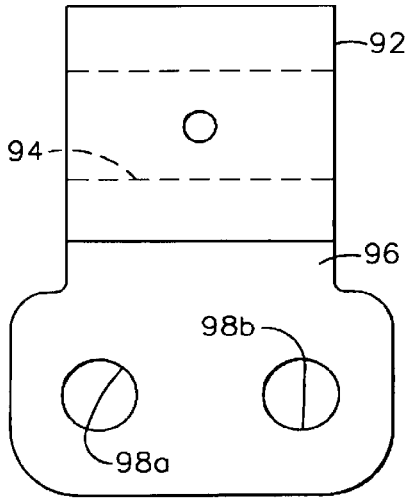
FIG. 20 is a front view of a transfer lever according to the present invention.
Figure 21:
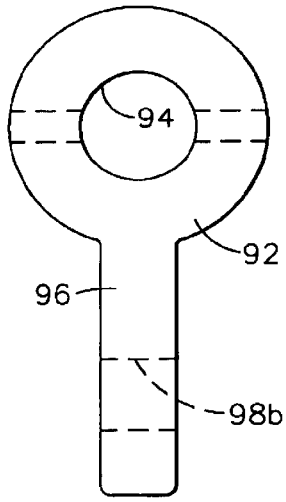
FIG. 21 is a side view of the lever of FIG. 20.
Figure 22:
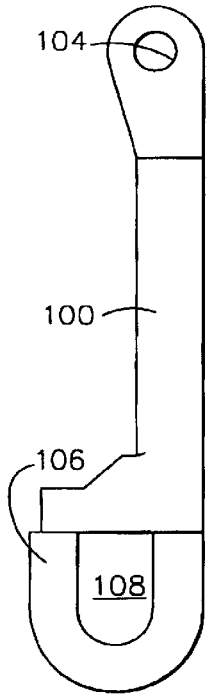
FIG. 22 is a side view of a shaft according to the present invention.
Figure 23:
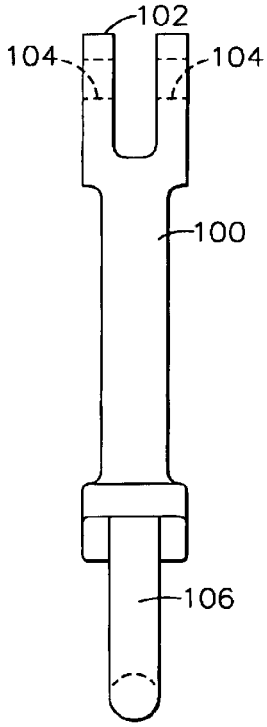
FIG. 23 is a front view of the shaft of FIG. 22.

Transfer lever 92 also contains planar section 96 (FIGS. 19 and 20) having a pair of openings 95*a,b*. A pair of door supports 100 are rotatably coupled to transfer lever 92 by a pair of pins 102 which each pass through planar section 96 between bifurcated section 102 of door support 100 having a pair of openings 104. Supports 100 are oriented such that rotational movement of actuating device 76 causes supports 100 to shift away from one another in opposite directions. The other end of support 100 contains a U-shaped link 106 having an open area 108.

Figure 24:
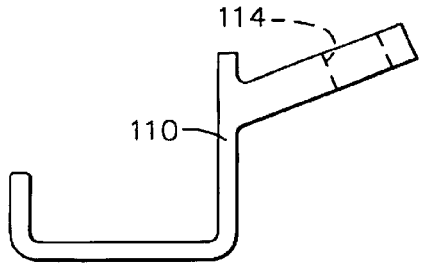
FIG. 24 is a side view of a door bracket according to the present invention.

Each transverse door 12 is coupled to support 100 by a bracket 110 (FIG. 24) which is affixed to door spreader 112 on door 12. Bracket 100 contains a pair of holes 114 suitable for receiving threaded ends 116 of U-bolt 118 which is inserted through open area 108 of link 106 of door support 100. A suitable nut 120 is threaded onto each end 116 of bolt 118 to secure door 12 to support 100.

Figure 6:
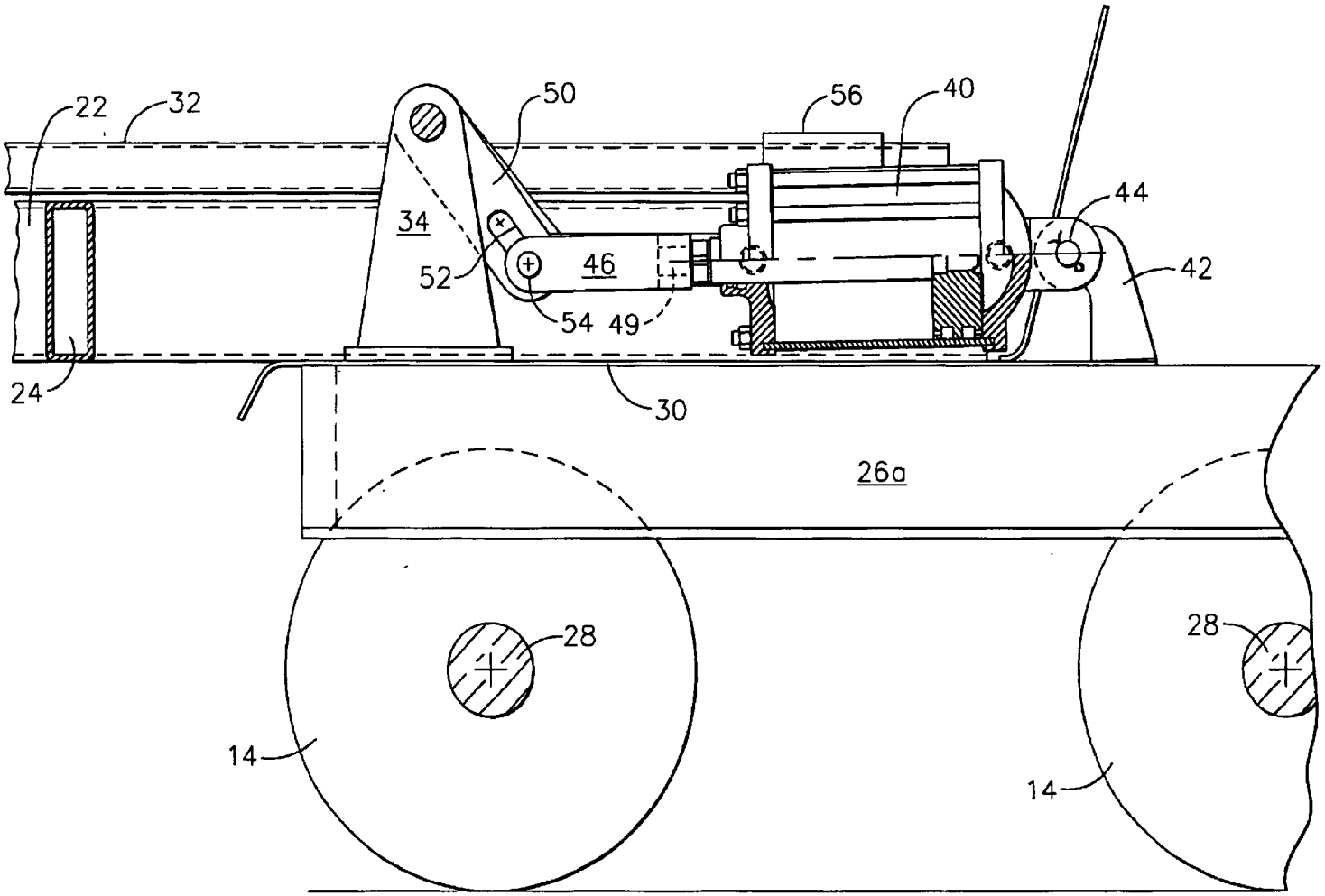
FIG. 6 is a sectional view taken along lines 6—6 of FIG. 3.

The operation of the present invention will now be described. When it is desired to open longitudinal doors 12 to empty railcar 10 of its contents, air is applied to cylinder 40, causing clevis 46 to begin to move away from cylinder 12. This movement causes pin 54 to travel within slot 52 of lever 50. Further travel of clevis 46 causes lever 50 to rotate in a clockwise direction as shown in FIG. 6. As lever 50 is rigidly affixed on operating shaft 36, shaft 36 also rotates in a clockwise direction.

Figure 4:
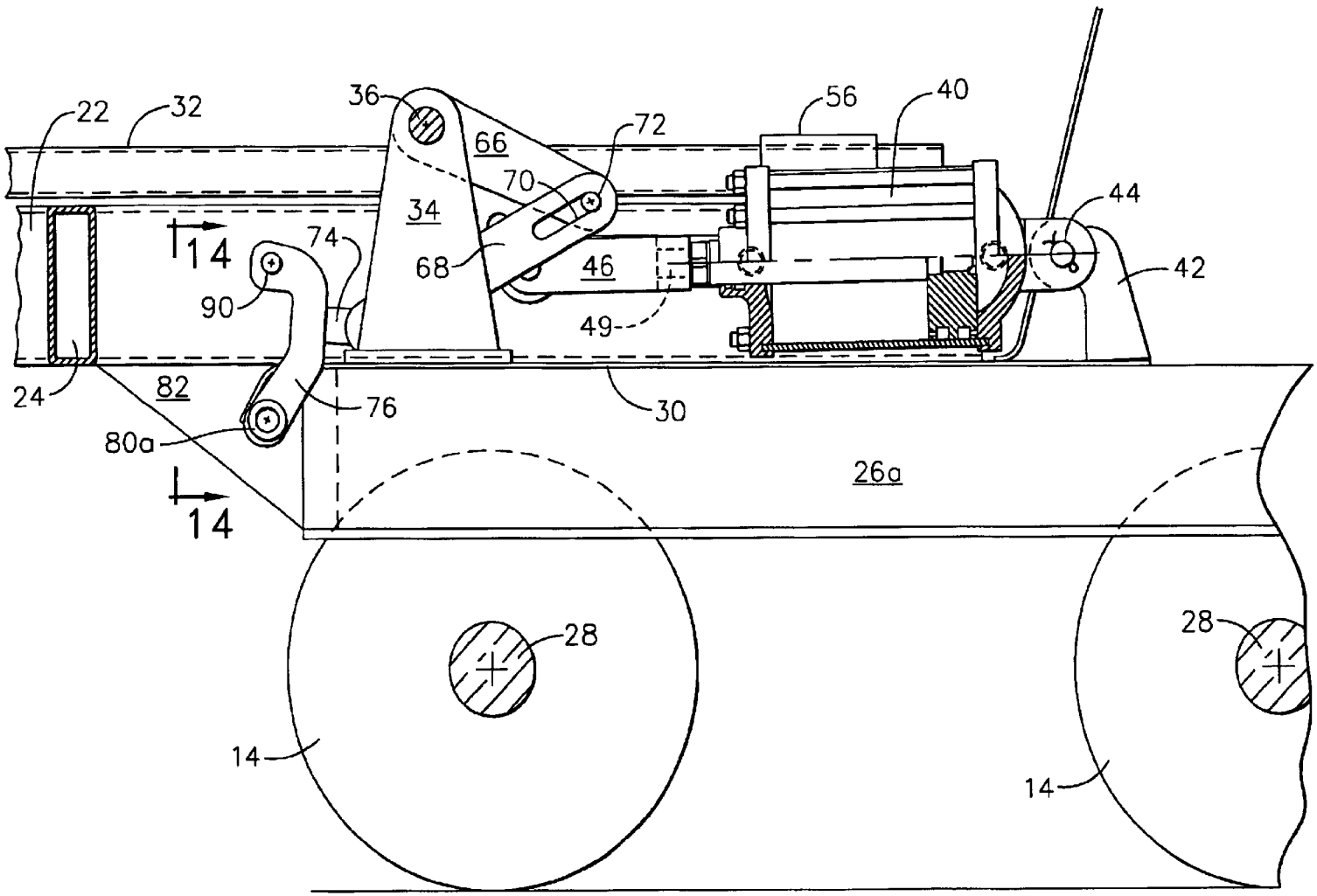
FIG. 4 is a sectional view taken along lines 4—4 of FIG. 3.
Figure 5:
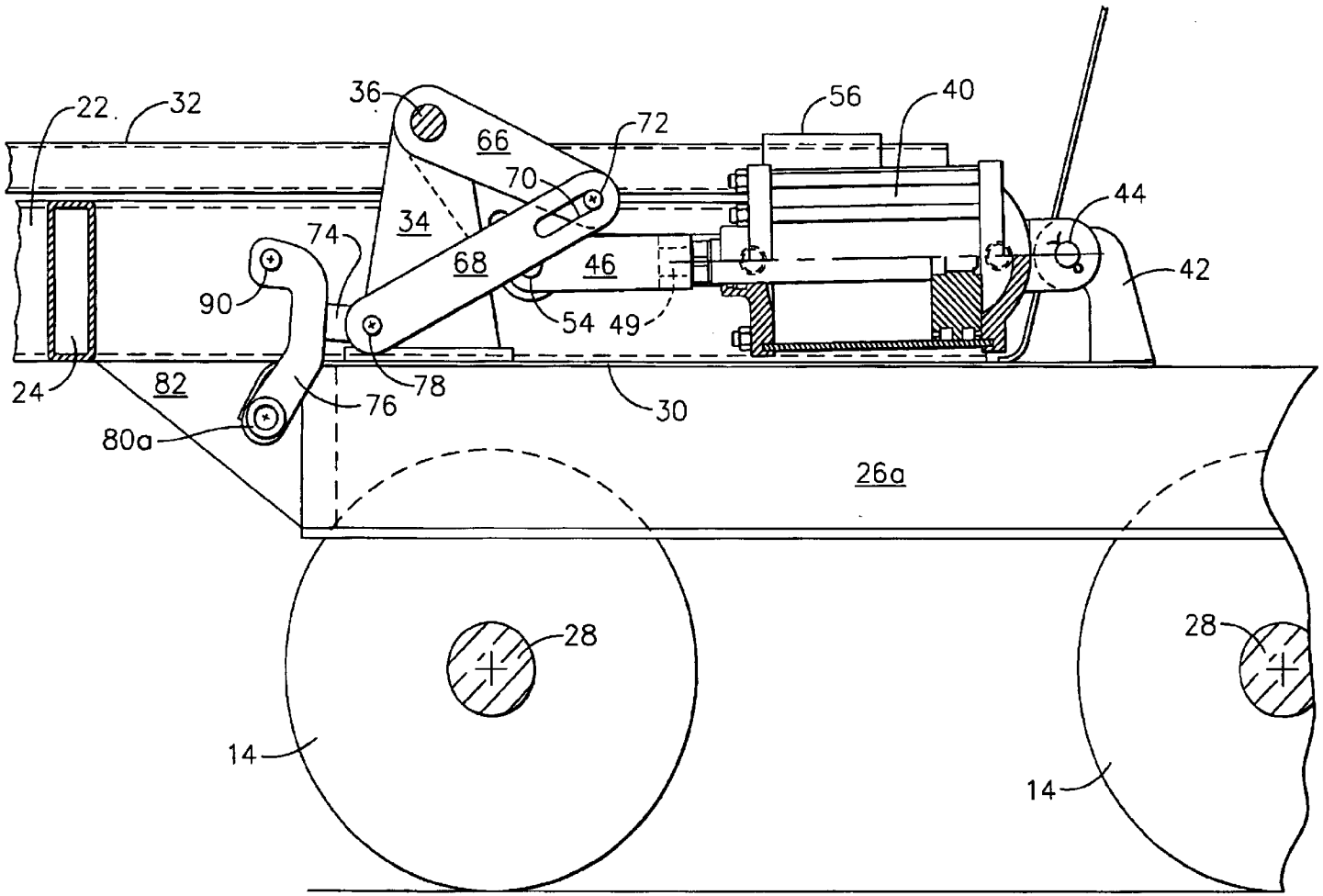
FIG. 5 is a sectional view taken along lines 5—5 of FIG. 3.
Figure 8:
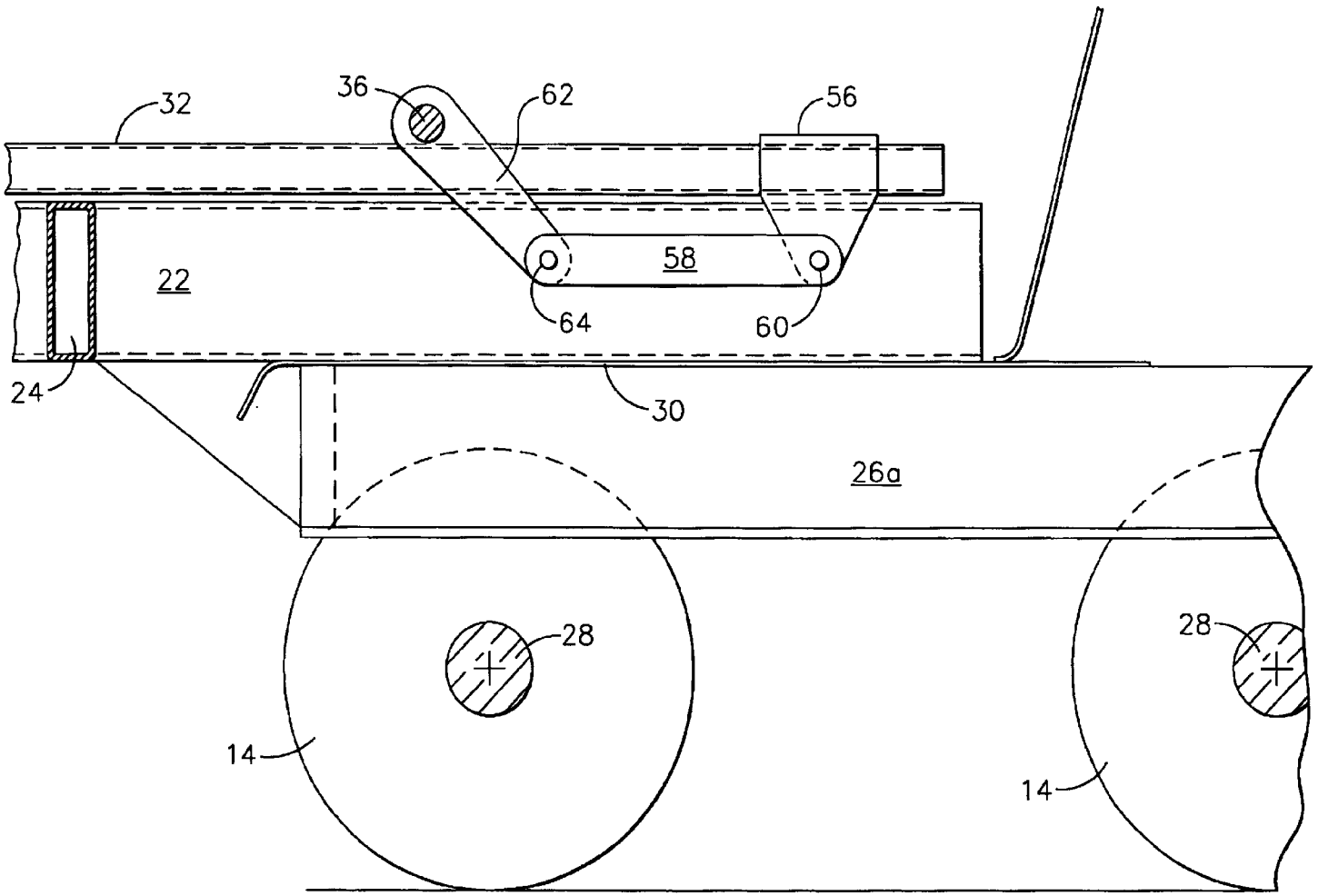
FIG. 8 is a sectional view taken along lines 8—8 of FIG. 3.
Figure 9:
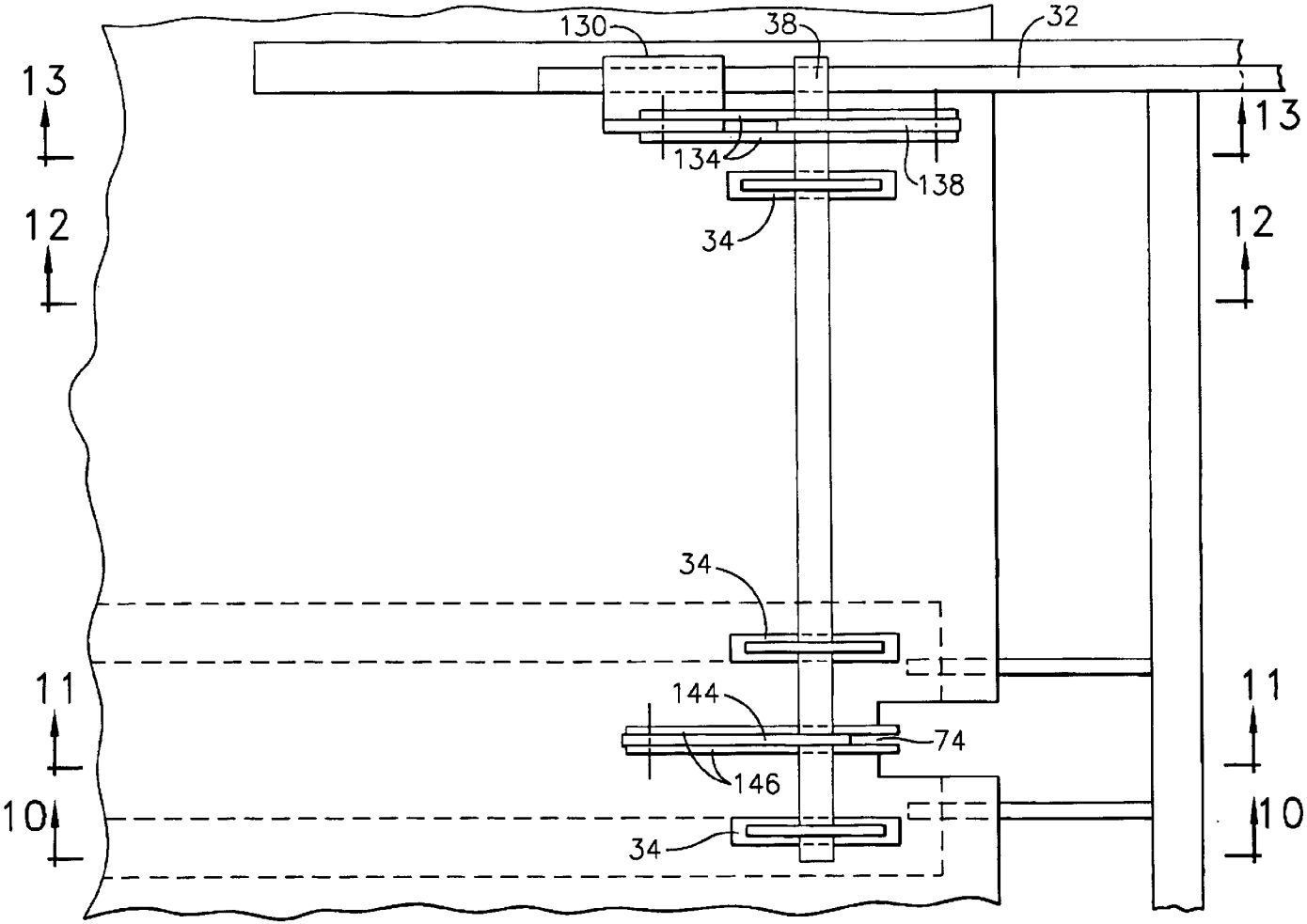
FIG. 9 is a top view of the other end of the door actuating mechanism of the present invention shown in the unactuated position.

The rotation of shaft 36 also causes lever 62 to rotate in a clockwise direction as seen in FIGS. 7 and 8. This movement causes horizontal link 58, fulcrum 56, and actuating beam 32, which are rigidly coupled together, to shift to the left, as seen in FIGS. 7 and 8. In addition, the rotation of shaft 36 causes lever 66, which is rigidly coupled to shaft 36, to rotate in a clockwise direction as seen in FIGS. 4 and 5. This movement causes pin 72 to travel within slot 70, eventually forcing levers 68 to move to the left, and applying force to extension 74 of actuating device 76. As force is applied to extension 74, actuating device 76 will rotate in a counterclockwise direction (FIGS. 4 and 5) about pivoting shafts 80*a,b*, which are fixed for rotation within shaft mount reinforcer 82.

At the opposite end of railcar 10 on stub sill 26*b*, as actuating beam 32 moves to the left (FIGS. 10–13), reversing fulcrum 130 causes links 134 to also move to the left. This movement rotates operating shaft 38 in a counterclockwise direction, as drive lever 138 is rotated. The rotation of shaft 38 also rotates lever 144 in the counterclockwise direction (FIGS. 10 and 11), causing pin 148 to travel within slot 150 until it applies force to extension 74 of actuating device 76. As force is applied to extension 74, actuating device 76 will rotate in a clockwise direction about pivoting shafts 80*a,b* which are fixed for rotation within shaft reinforcer 82.

Figure 25:
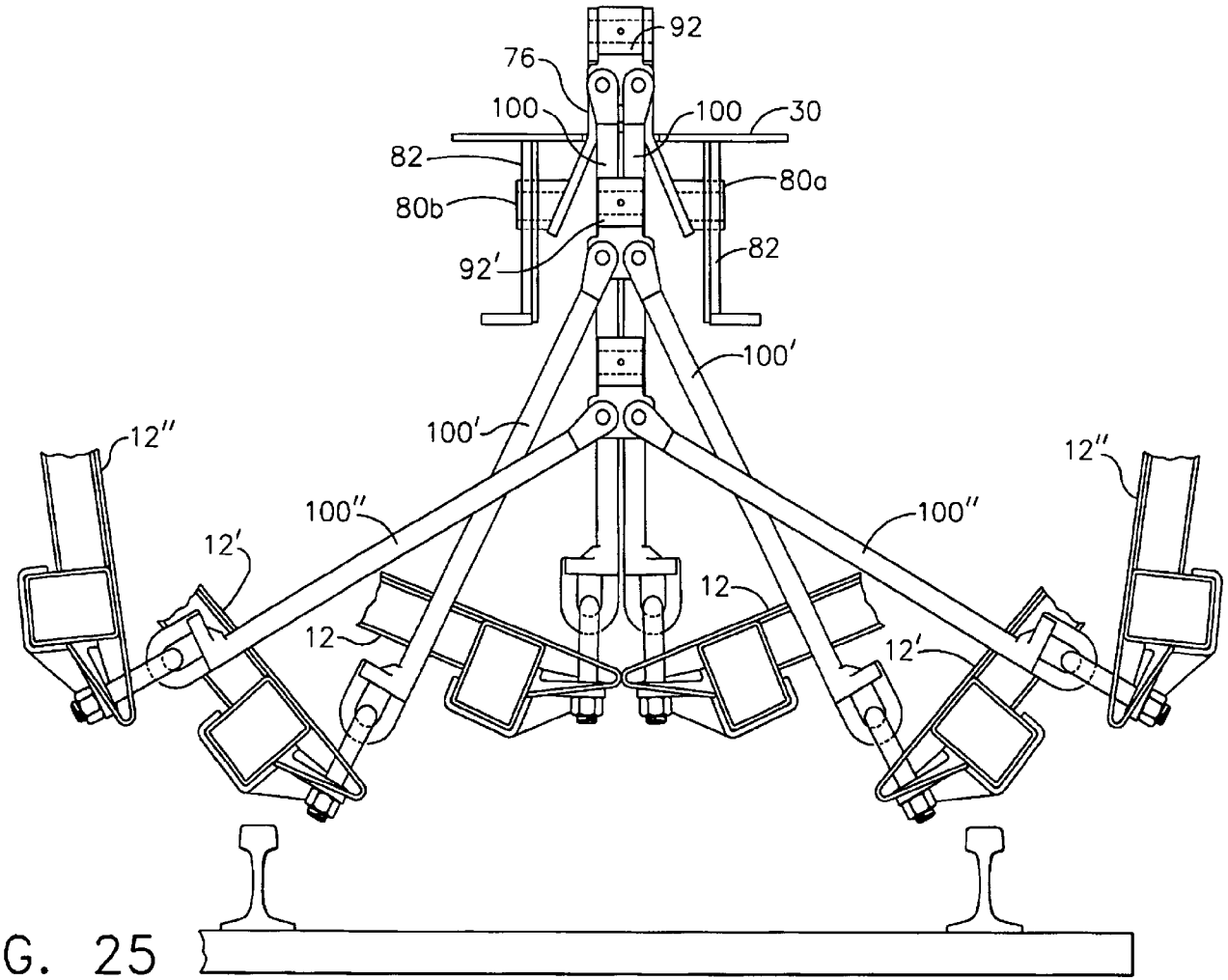
FIG. 25 is a partial sectional view showing the sequence of the opening of the doors of the present invention.

With both actuating devices 76 rotating simultaneously in opposite directions, door supports 100 at each end of car 10 begin to shift away from one another, as can be most clearly seen in FIG. 25. Referring now to FIG. 25, as device 76 rotates about shafts 80*a,b*, transfer lever 92 moves to the position shown as 92', while supports 100 separate to the positions shown as 100', and doors 12 separate to the positions shown at 12'. Further rotation of devices 76, aided by the weight of the material in the hopper, causes further movement of the supports and doors to the positions shown at 100" and 12", allowing the contents of car 10 to empty quickly. If it is desired to permit car 10 to empty the contents only between the rails, door stops may be added to the underside of car 10 such that the doors will stop in the position shown at 12'.

After the contents of car 10 have been discharged, doors 12 are closed by reversing the movement of activating shaft 49 of air cylinder. This movement causes operating shafts 36 and 38 to rotate in the opposite directions, and actuating members 76 each return to their original position, closing doors 12.

The present invention provides many advantages over the known prior art. By equipping a longitudinal door railcar with the present invention, the cubic capacity of the car is increased and the center of gravity is lowered compared to the currently available designs. The use of one large discharge opening, rather than several small intermittent openings, allows an unrestricted flow, permitting even the densest materials to flow through the doors easily. Other advantages of this design include: no special tools are needed for adjustments; fewer parts are used in this design; the mechanism can be installed on new cars and can also be retrofitted onto existing cars; and the system may be installed on cars without center sills or on cars having CSC type or CZ type center sills.

In the above description, and in the claims which follow, the use of such words as "clockwise", "counterclockwise", "distal", "proximal", "forward", "rearward", "vertical", "horizontal", and the like is in conjunction with the drawings for purposes of clarity.

While the invention has been shown and described in terms of a preferred embodiment, it will be understood that this invention is not limited to this particular embodiment and that many changes and modifications may be made without departing from the true spirit and scope of the invention as defined in the appended claims.

What is claimed is:

1. A railroad hopper car having longitudinal doors for closing the hoppers, comprising:

a body having a first end and a second end;

at least one hopper along the underside of said body;

a plurality of doors, each having a first end and a second end, situated in a longitudinal direction to said body for opening and closing said hopper, said doors rotatable between a first closed position and a second open position;

a power source having an actuating shaft movable from a first position where said doors are closed to a second position where said doors are open;

a first operating shaft, coupled to said power source and mounted for rotation at said first end of said body;

a second operating shaft, mounted for rotation at said second end of said body;

an actuating beam, coupled to said first operating shaft at said first end and coupled to said second operating shaft at said second end;

a first actuating member rotatably coupled to said first end of the body;

a second actuating member rotatably coupled to said second end of the body;

a first set of door supports located at said first end, with one end of each support coupled to a first end of a longitudinal door and the other end coupled for rotation to said first actuating member;

a second set of door supports located at said second end with one end of each support coupled to a second end of a longitudinal door and the other end coupled for rotation to said second actuating member;

wherein as said power source is activated from said first closed position to said second open position, said operating shafts rotate simultaneously such that said first and second actuating members cause said door supports of each set to rotate in opposite directions, shifting said doors from said first closed position to said second open position.

2. The car of claim 1, further comprising a frame mounted between said first end and said second end of said body.

3. The car of claim 1, wherein said first end of said body contains a stub sill.

4. The car of claim 1, wherein said second end of said body contains a stub sill.

5. The car of claim 1, wherein said first and second actuating members each consist of:

a first bifurcated section for rotatably coupling a set of door supports between said bifurcation;

a pair of outwardly extending mounting shafts for rotatably coupling said actuating member to said body;

and an extension located between said bifurcated section and said mounting shafts, for coupling said actuating member to an operating shaft.

6. The car of claim 5, further comprising a pair of transfer levers each having a first end coupled for rotation between said bifurcated section of said actuating member and a second end for rotatably coupling a set of door supports.

7. The car of claim 1, further comprising a first drive lever coupled to said activating shaft of said power source at one end of said lever and rigidly affixed to said first operating shaft at its other end, such that when said power source is activated, said first drive lever causes rotation of said first operating shaft.

8. The car of claim 1, further comprising a plurality of pedestal bases for supporting said first and second operating shafts at said first and second ends of said body of said car.

9. The car of claim 7, further comprising:

a second drive lever linked at one end to said actuating beam at said second end of said car and rigidly affixed to said second operating shaft at its other end, such that when said power source is activated, said actuating beam causes said second drive lever to rotate said second operating shaft.

10. The car of claim 1, further comprising a center sill extending between said first end and said second end of said body.

11. The car of claim 5, further comprising a first linkage coupling said first operating shaft to said extension of said first actuating member.

12. The car of claim 11, further comprising a second linkage coupling said second operating shaft to said extension of said second actuating member.

13. A mechanism for actuating the doors of a hopper car, said car being equipped with a power cylinder, a body having a first end and a second end, and a pair of longitudinal doors, each having a first end and a second end, extending between said first and second ends of said body, said doors rotatable between a first position closing the hopper and a second position opening the hopper, said mechanism comprising:

a first operating shaft, coupled to the power cylinder, mounted for rotation at the first end of the body;

a second operating shaft mounted for rotation at the second end of the body;

an actuating beam, coupled to said first operating shaft at the first end and coupled to said second operating shaft at the second end;

a first actuating member coupled for rotation to the first end of the body;

a second actuating member coupled for rotation to the second end of the body;

a first set of door supports located at the first end of the body, with one end of each door support coupled to the first end of a longitudinal door and the other end coupled for rotation to said first actuating member;

a second set of door supports located at the second end of the body, with one end of each door support coupled to the second end of a longitudinal door and the other end coupled for rotation to said second actuating member;

wherein when the power cylinder is activated, said operating shafts rotate such that said first and second actuating members rotate, causing said door supports of each set to shift in opposite directions to rotate the longitudinal doors from said first closed position to said second open position.

14. The mechanism of claim 13, further comprising a plurality of pedestal bases for supporting said first and second operating shafts.

15. The mechanism of claim 13, wherein said first and second actuating members each consist of:

a first bifurcated section for rotatably coupling a set of door supports between said bifurcations;

a pair of outwardly extending mounting shafts for rotatably coupling said operating member to the car body;

and an extension located between said bifurcated section and said mounting shafts for coupling said member to an operating shaft.

16. The mechanism of claim 13, further comprising a plurality of transfer levers each having a first end coupled for rotation between said bifurcations of said actuating member and a second end for rotatably coupling a set of door supports to said actuating member.

17. A railroad hopper car having longitudinal doors for closing the hopper, comprising:

a body having a first end and a second end;

a frame mounted between said first end and said second end of said body;

a hopper, contained within said frame along the underside of said body;

a plurality of doors, each having a first end and a second end, situated in a longitudinal direction with respect to the car for opening and closing said hopper, said doors rotatable between a first closed and a second open position;

a powered cylinder having an actuating shaft movable from a first inactive position where said doors are closed and a second active position where said doors are open;

a first operating shaft, mounted for rotation at said first end of said body;

a first drive lever coupled to said actuating shaft of said cylinder at one end and rigidly affixed at its other end to said first operating shaft;

a second operating shaft, mounted for rotation at said second end of said body;

a plurality of pedestal bases for supporting said first and second operating shafts;

an actuating beam, coupled to said first operating shaft at said first end and coupled to said second operating shaft at said second end;

a second drive lever coupled to said actuating beam at one end and rigidly affixed at its other end to said second operating shaft;

a first actuating device, having a first end rotatably coupled to said first end of said body, a bifurcated second end, and an extension located between said first end and said second end;

a second actuating device, having a first end rotatably coupled to said second end of said body, a bifurcated second end and an extension located between said first end and said second end;

a first set of door supports located at said first end of said body, with one end of each support coupled to a first end of said doors and the other end coupled for rotation at said bifurcated second end of said first actuating device;

a second set of door supports located at said second end of said body, with one end of each support coupled to a second end of said doors and the other end coupled for rotation at said bifurcated second end of said second actuating device;

a first linkage coupling said first operating shaft to said extension of said first actuating device;

and a second linkage, coupling said second operating shaft to said extension of said second actuating device;

wherein when said actuating shaft of said cylinder is moved from said first position to said second position, said operating shafts rotate simultaneously such that said first and second actuating devices cause said door supports of each set to rotate away from each other, shifting said plurality of doors from said first closed to said second open position.

18. The car of claim 17, wherein said first end of said body comprises a stub sill.

19. The car of claim 18, wherein said second end of said body comprises a stub sill.

* * * * *